US011497322B2

(12) United States Patent
Negus et al.

(10) Patent No.: US 11,497,322 B2
(45) Date of Patent: Nov. 15, 2022

(54) ZIPPER MATTRESS ATTACHMENT

(71) Applicant: Sleep Number Corporation, Minneapolis, MN (US)

(72) Inventors: Natalie Negus, Minneapolis, MN (US); David Smith, Minneapolis, MN (US); Matthew Griffith, Buffalo, MN (US)

(73) Assignee: Sleep Number Corporation, Minneapolis, MN (US)

( * ) Notice: Subject to any disclaimer, the term of this patent is extended or adjusted under 35 U.S.C. 154(b) by 76 days.

(21) Appl. No.: 17/036,541

(22) Filed: Sep. 29, 2020

(65) Prior Publication Data

US 2021/0145183 A1 May 20, 2021

Related U.S. Application Data

(60) Provisional application No. 62/935,762, filed on Nov. 15, 2019.

(51) Int. Cl.

| | |
|---|---|
| ***A47C 31/02*** | (2006.01) |
| ***A47C 21/06*** | (2006.01) |
| ***A47C 27/00*** | (2006.01) |
| ***A47C 20/04*** | (2006.01) |
| ***A47C 21/02*** | (2006.01) |

(52) U.S. Cl.

CPC ..... *A47C 31/023* (2013.01); *A47C 20/048* (2013.01); *A47C 21/026* (2013.01); *A47C 21/06* (2013.01); *A47C 27/001* (2013.01); *A47C 27/002* (2013.01)

(58) Field of Classification Search

CPC ... A47C 31/023; A47C 20/048; A47C 21/026; A47C 21/06; A47C 27/001; A47C 27/002; A47C 31/105; A47C 27/082; A47C 27/144

See application file for complete search history.

(56) References Cited

U.S. PATENT DOCUMENTS

| | | | |
|---|---|---|---|
| 4,766,628 | A | 8/1988 | Greer et al. |
| 4,788,729 | A | 12/1988 | Greer et al. |
| D300,194 | S | 3/1989 | Walker |

(Continued)

FOREIGN PATENT DOCUMENTS

| | | | | |
|---|---|---|---|---|
| DE | 202015008174 | * | 2/2016 | ..... A47C 31/10 |
| EP | 2468142 | | 6/2012 | |
| WO | WO2018089464 | | 5/2018 | |

OTHER PUBLICATIONS

"Secure." Merriam-Webster, Merriam-Webster, www.merriam-webster.com/dictionary/secure.*

(Continued)

*Primary Examiner* — David R Hare
*Assistant Examiner* — Madison Emanski
(74) *Attorney, Agent, or Firm* — Fish & Richardson P.C.

(57) ABSTRACT

A system can include a zipper that connects a mattress to a bed foundation. For example, the zipper can extend from a head end to a foot end of an adjustable foundation. For another example, a zipper can connect to a mattress along a seam of the mattress and/or to a foundation along a seam of a foundation. For another example, a first zipper can connect the mattress core to a second zipper and the second zipper can connect a foundation to the first zipper. For another example, first and second zippers can be substantially vertically aligned.

14 Claims, 6 Drawing Sheets

(56) References Cited

U.S. PATENT DOCUMENTS

| | | | | |
|---|---|---|---|---|
| 4,829,616 | A | 5/1989 | Walker | |
| 4,890,344 | A | 1/1990 | Walker | |
| 4,897,890 | A | 2/1990 | Walker | |
| 4,908,895 | A | 3/1990 | Walker | |
| D313,973 | S | 1/1991 | Walker | |
| 4,991,244 | A | 2/1991 | Walker | |
| 5,144,706 | A | 9/1992 | Walker et al. | |
| 5,170,522 | A | 12/1992 | Walker | |
| D368,475 | S | 4/1996 | Scott | |
| 5,509,154 | A | 4/1996 | Shafer et al. | |
| 5,564,140 | A | 10/1996 | Shoenhair et al. | |
| 5,642,546 | A | 6/1997 | Shoenhair | |
| 5,652,484 | A | 7/1997 | Shafer et al. | |
| 5,765,246 | A | 6/1998 | Shoenhair | |
| 5,903,941 | A | 5/1999 | Shafer et al. | |
| 5,904,172 | A | 5/1999 | Gifft et al. | |
| 6,037,723 | A | 3/2000 | Shafer et al. | |
| 6,108,844 | A | 8/2000 | Kraft et al. | |
| 6,161,231 | A | 12/2000 | Kraft et al. | |
| 6,202,239 | B1 | 3/2001 | Ward et al. | |
| 6,397,419 | B1 | 6/2002 | Mechache | |
| 6,483,264 | B1 | 11/2002 | Shafer et al. | |
| 6,686,711 | B2 | 2/2004 | Rose et al. | |
| 6,708,357 | B2 | 3/2004 | Gaboury et al. | |
| 6,763,541 | B2 | 7/2004 | Mahoney et al. | |
| 6,804,848 | B1 | 10/2004 | Rose | |
| 6,832,397 | B2 | 12/2004 | Gaboury | |
| D502,929 | S | 3/2005 | Copeland et al. | |
| 6,883,191 | B2 | 5/2005 | Gaboury et al. | |
| 6,889,396 | B2 | 5/2005 | Weinman | |
| 7,047,579 | B2 | 5/2006 | Piana et al. | |
| 7,389,554 | B1 | 6/2008 | Rose | |
| 7,865,988 | B2 | 1/2011 | Koughan et al. | |
| 8,176,582 | B2 | 5/2012 | Beard et al. | |
| 8,336,369 | B2 | 12/2012 | Mahoney | |
| 8,444,558 | B2 | 5/2013 | Young et al. | |
| D691,118 | S | 10/2013 | Ingham et al. | |
| D697,874 | S | 1/2014 | Stusynski et al. | |
| D698,338 | S | 1/2014 | Ingham | |
| D701,536 | S | 3/2014 | Shakal | |
| 8,671,478 | B2 | 3/2014 | Rippe et al. | |
| 8,672,853 | B2 | 3/2014 | Young | |
| 8,701,227 | B2 * | 4/2014 | Rohr | A47C 21/026 5/482 |
| 8,769,747 | B2 | 7/2014 | Mahoney et al. | |
| 8,893,339 | B2 | 11/2014 | Fleury | |
| 8,931,329 | B2 | 1/2015 | Mahoney et al. | |
| 8,966,689 | B2 | 3/2015 | McGuire et al. | |
| 8,973,183 | B1 | 3/2015 | Palashewski et al. | |
| 8,984,687 | B2 | 3/2015 | Stusynski et al. | |
| 9,049,941 | B2 | 6/2015 | Clenet et al. | |
| D737,250 | S | 8/2015 | Ingham et al. | |
| 9,107,782 | B2 | 8/2015 | Ermalovich | |
| 9,131,781 | B2 | 9/2015 | Zaiss et al. | |
| 9,204,742 | B2 | 12/2015 | Jensen et al. | |
| 9,220,351 | B2 | 12/2015 | Jensen et al. | |
| 9,370,457 | B2 | 6/2016 | Nunn et al. | |
| 9,392,879 | B2 | 7/2016 | Nunn et al. | |
| 9,510,688 | B2 | 12/2016 | Nunn et al. | |
| 9,516,952 | B2 | 12/2016 | Rohr et al. | |
| 9,635,953 | B2 | 5/2017 | Nunn et al. | |
| 9,730,524 | B2 | 8/2017 | Chen et al. | |
| 9,737,154 | B2 | 8/2017 | Mahoney et al. | |
| 9,770,114 | B2 | 9/2017 | Brosnan et al. | |
| D809,843 | S | 2/2018 | Keeley et al. | |
| D812,393 | S | 3/2018 | Karschnik et al. | |
| 9,924,813 | B1 | 3/2018 | Basten et al. | |
| 10,058,467 | B2 | 8/2018 | Stusynski et al. | |
| 10,092,242 | B2 | 10/2018 | Nunn et al. | |
| 10,143,312 | B2 | 12/2018 | Brosnan et al. | |
| 10,149,549 | B2 | 12/2018 | Erko et al. | |
| 10,182,661 | B2 | 1/2019 | Nunn et al. | |
| 10,194,752 | B2 | 2/2019 | Zaiss et al. | |
| 10,194,753 | B2 | 2/2019 | Fleury et al. | |
| 10,201,234 | B2 | 2/2019 | Nunn et al. | |
| 10,251,490 | B2 | 4/2019 | Nunn et al. | |
| 10,342,358 | B1 | 7/2019 | Palashewski et al. | |
| 10,729,253 | B1 | 8/2020 | Gaunt | |
| 10,736,434 | B1 | 8/2020 | Kinion | |
| 2004/0045086 | A1 | 3/2004 | Zheng | |
| 2008/0077020 | A1 | 3/2008 | Young et al. | |
| 2008/0134431 | A1 | 6/2008 | Piana | |
| 2010/0325800 | A1 | 12/2010 | Huang | |
| 2011/0144455 | A1 | 6/2011 | Young et al. | |
| 2012/0199623 | A1 | 8/2012 | Nolt | |
| 2014/0250597 | A1 | 9/2014 | Chen et al. | |
| 2014/0259418 | A1 | 9/2014 | Nunn et al. | |
| 2014/0277822 | A1 | 9/2014 | Nunn et al. | |
| 2015/0007393 | A1 | 1/2015 | Palashewski | |
| 2015/0025327 | A1 | 1/2015 | Young et al. | |
| 2015/0182397 | A1 | 7/2015 | Palashewski et al. | |
| 2015/0182399 | A1 | 7/2015 | Palashewski et al. | |
| 2015/0182418 | A1 | 7/2015 | Zaiss | |
| 2016/0100696 | A1 | 4/2016 | Palashewski et al. | |
| 2016/0100697 | A1 | 4/2016 | Prochazka et al. | |
| 2016/0150890 | A1 | 6/2016 | Heeke et al. | |
| 2016/0242562 | A1 | 8/2016 | Karschnik et al. | |
| 2016/0262552 | A1 | 9/2016 | Scarleski | |
| 2016/0338871 | A1 | 11/2016 | Nunn et al. | |
| 2016/0367039 | A1 | 12/2016 | Young et al. | |
| 2017/0003666 | A1 | 1/2017 | Nunn et al. | |
| 2017/0049243 | A1 | 2/2017 | Nunn et al. | |
| 2017/0112293 | A1 * | 4/2017 | Battaglia | A47C 27/04 |
| 2017/0191516 | A1 | 7/2017 | Griffith et al. | |
| 2017/0303697 | A1 | 10/2017 | Chen et al. | |
| 2017/0318980 | A1 | 11/2017 | Mahoney et al. | |
| 2017/0354268 | A1 | 12/2017 | Brosnan et al. | |
| 2018/0116415 | A1 | 5/2018 | Karschnik et al. | |
| 2018/0116418 | A1 | 5/2018 | Shakal et al. | |
| 2018/0116419 | A1 | 5/2018 | Shakal et al. | |
| 2018/0116420 | A1 | 5/2018 | Shakal | |
| 2018/0119686 | A1 | 5/2018 | Shakal et al. | |
| 2018/0125259 | A1 | 5/2018 | Peterson et al. | |
| 2018/0125260 | A1 | 5/2018 | Peterson et al. | |
| 2019/0029597 | A1 | 1/2019 | Nunn et al. | |
| 2019/0059603 | A1 | 2/2019 | Griffith et al. | |
| 2019/0082855 | A1 | 3/2019 | Brosnan et al. | |
| 2019/0104858 | A1 | 4/2019 | Erko et al. | |
| 2019/0125095 | A1 | 5/2019 | Nunn et al. | |
| 2019/0125097 | A1 | 5/2019 | Nunn et al. | |
| 2019/0200777 | A1 | 7/2019 | Demirli et al. | |
| 2019/0201265 | A1 | 7/2019 | Sayadi et al. | |
| 2019/0201266 | A1 | 7/2019 | Sayadi et al. | |
| 2019/0201267 | A1 | 7/2019 | Demirli et al. | |
| 2019/0201268 | A1 | 7/2019 | Sayadi et al. | |
| 2019/0201269 | A1 | 7/2019 | Sayadi et al. | |
| 2019/0201270 | A1 | 7/2019 | Sayadi et al. | |
| 2019/0201271 | A1 | 7/2019 | Grey et al. | |
| 2019/0206416 | A1 | 7/2019 | Demirli et al. | |
| 2019/0209405 | A1 | 7/2019 | Sayadi et al. | |
| 2019/0279745 | A1 | 9/2019 | Sayadi et al. | |
| 2019/0328146 | A1 | 10/2019 | Palashewski et al. | |
| 2020/0000241 | A1 * | 1/2020 | Jansen | A47C 31/105 |
| 2020/0071079 | A1 | 3/2020 | Shutes et al. | |
| 2020/0138653 | A1 | 5/2020 | McGuire et al. | |
| 2020/0187667 | A1 | 6/2020 | Shakal | |
| 2020/0221883 | A1 | 7/2020 | McGuire et al. | |
| 2020/0256367 | A1 | 8/2020 | Peterson et al. | |
| 2020/0297126 | A1 | 9/2020 | Hewitt et al. | |
| 2020/0359805 | A1 | 11/2020 | Brosnan et al. | |
| 2020/0367663 | A1 | 11/2020 | Hewitt et al. | |
| 2021/0038454 | A1 | 2/2021 | Brykalski et al. | |
| 2021/0045541 | A1 | 2/2021 | Hewitt et al. | |
| 2021/0052451 | A1 | 2/2021 | Marquette et al. | |

OTHER PUBLICATIONS

"Foam." The Free Dictionary, www.thefreedictionary.com/foam.*
U.S. Appl. No. 16/682,675, Demirli et al., filed Nov. 13, 2019.
U.S. Appl. No. 16/714,312, Demirli et al., filed Dec. 13, 2019.
U.S. Appl. No. 16/714,349, Sayadi et al., filed Dec. 13, 2019.
U.S. Appl. No. 16/730,464, Sayadi et al., filed Dec. 30, 2019.
U.S. Appl. No. 16/731,577, Negus et al., filed Dec. 31, 2019.

(56) References Cited

OTHER PUBLICATIONS

U.S. Appl. No. 16/731,986, Holmvik et al., filed Dec. 31, 2019.
U.S. Appl. No. 16/891,773, Brosnan et al., filed Jun. 3, 2020.
U.S. Appl. No. 16/895,486, Brykalski et al., filed Jun. 8, 2020.
U.S. Appl. No. 16/936,540, Sayadi et al., filed Jul. 23, 2020.
U.S. Appl. No. 17/001,081, Palashewski et al., filed Aug. 24, 2020.
U.S. Appl. No. 17/006,388, Stusynski et al., filed Aug. 28, 2020.
U.S. Appl. No. 17/018,578, Griffith et al., filed Sep. 11, 2020.
U.S. Appl. No. 17/078,558, Hilden et al., filed Oct. 23, 2020.
U.S. Appl. No. 17/091,094, Rose et al., filed Nov. 6, 2020.
U.S. Appl. No. 17/098,968, Smith et al., filed Nov. 16, 2020.
U.S. Appl. No. 17/136,741, Hilden et al., filed Dec. 29, 2020.
U.S. Appl. No. 17/139,227, Grabinger et al., filed Dec. 31, 2020.
U.S. Appl. No. 17/139,243, Grabinger et al., filed Dec. 31, 2020.
U.S. Appl. No. 17/139,259, Grabinger et al., filed Dec. 31, 2020.
U.S. Appl. No. 17/139,353, Yang et al., filed Dec. 31, 2020.
U.S. Appl. No. 17/139,668, Norell et al., filed Dec. 31, 2020.
U.S. Appl. No. 17/139,683, Yang et al., filed Dec. 31, 2020.
U.S. Appl. No. 17/139,785, Yang et al., filed Dec. 31, 2020.
U.S. Appl. No. 17/139,786, Yang et al., filed Dec. 31, 2020.
U.S. Appl. No. 17/139,789, Yang et al., filed Dec. 31, 2020.
U.S. Appl. No. 17/139,851, Norell et al., filed Dec. 31, 2020.
U.S. Appl. No. 17/140,702, Norell et al., filed Jan. 4, 2021.
U.S. Appl. No. 17/145,645, Shakal; Anthony, filed Jan. 11, 2021.
U.S. Appl. No. 17/189,618, Stusynski; Stusynski, filed Mar. 2, 2021.
U.S. Appl. No. 29/583,852, Keeley, filed Nov. 9, 2016.
U.S. Appl. No. 29/676,117, filed Jan. 8, 2019, Stusynski et al.
U.S. Appl. No. 29/690,492, filed May 8, 2019, Stusynski et al.
U.S. Appl. No. 29/719,090, Negus et al., filed Dec. 31, 2019.
PCT International Search Report and Written Opinion in International Application No. PCT/US2020/053423, dated Feb. 1, 2021, 20 pages.

* cited by examiner

ZIPPER MATTRESS ATTACHMENT

CROSS-REFERENCE TO RELATED APPLICATIONS

This application claims the benefit of U.S. Provisional Application Ser. No. 62/935,762, filed Nov. 15, 2019. The disclosure of the prior application is considered part of (and is incorporated by reference in) the disclosure of this application.

TECHNICAL FIELD

This invention relates to beds, and more particularly, to beds with zippers.

BACKGROUND

People have traditionally used beds that come in many shapes, sizes, and styles. Such beds can range from extremely simple designs to rather complex designs that include a variety of features. For example, some beds include mattresses that include foam, inner-springs, air chambers, other materials, or combinations thereof.

Such mattresses may be supported by a structure such as a frame, box spring, adjustable foundation, or a non-adjustable foundation. For adjustable foundations, portions of the mattress can be raised and lowered, such as a head and foot of the mattress.

SUMMARY

Some embodiments of a bed system provided herein can include one or more of the features and functions disclosed herein. In particular, the bed system can include an adjustable foundation, a mattress positioned on the adjustable foundation, wherein the mattress has a head end and a foot end, and a zipper that extends from the head end to the foot end of the mattress. The zipper can connect the mattress to the adjustable foundation. The zipper can comprise a first zipper tape attached along a seam of an underside of the mattress and a second zipper tape attached along a seam of a top of the adjustable foundation. The first and second zipper tapes can include first and second teeth, respectively, and the second teeth can be configured to engage the first teeth. The zipper connecting the mattress to the adjustable foundation can be configured to retain the mattress to the adjustable foundation when the adjustable foundation is actuated to raise at least one of the head end and the foot end of the mattress. In some embodiments, the first zipper tape can be attached to the underside of the mattress by sewing the first zipper tape into the seam of the underside of the mattress. In addition, the second zipper tape can be attached to the top of the adjustable foundation by sewing the second zipper tape into the seam of the top of the adjustable foundation.

In yet other embodiments, the foundation can have a first perimeter and the mattress can have a second perimeter. The first zipper tape can be connected to a top of the foundation at a first zipper location that is interior of the first perimeter. The second zipper tape can be connected to an underside of the mattress at a second zipper location that is interior of the second perimeter. The first and second zipper locations can be substantially vertically aligned. The first zipper tape can be sewn into a seam interior to the first perimeter along the top of the foundation and the second zipper tape can be sewn into a seam interior to the second perimeter along the underside of the mattress.

In some embodiments, the adjustable foundation can also provide at least one articulation point, wherein the zipper extends across the at least one articulation point. The adjustable foundation can comprise a platform with at least a head panel, a middle panel, and a foot panel, wherein at least one panel is raised or lowered when the adjustable foundation is actuated. The articulation point can also be positioned between the head panel and the middle panel such that the zipper extends along a portion of the head panel, across the articulation point, and along a portion of the middle panel.

In some embodiments, the bed system can further comprise an air chamber within the mattress, wherein a second zipper connects the air chamber to an interior portion of the mattress. In such embodiments, the zipper connecting the mattress to the adjustable foundation can be substantially vertically aligned with the second zipper connecting the air chamber to the interior portion of the mattress. Further, the second zipper can be attached along a seam of at least one of a bottom of the air chamber and the interior portion of the mattress. In some embodiments, the second zipper can be attached at a corner of the air chamber. In yet other examples, a first zipper tape of the first zipper and a second zipper tape of the second zipper can be sewn to a common seam of a mattress cover. In some embodiments, the bed system can further comprise an upside down foam tub positioned above the air chamber.

The bed system can further comprise a mattress cover surrounding the mattress, wherein the zipper is attached to the mattress cover and configured to couple the mattress cover to the top of the adjustable foundation at a bottom of the mattress. The zipper can be attached along a seam of at least one of an exterior underside of the mattress cover and the top of the foundation.

In some embodiments, the adjustable foundation can further comprise an actuator and a controller. The controller can be operably connected to the actuator and configured to drive the actuator to actuate at least one portion of the adjustable foundation between a lower position and an upper position. The bed system described herein can further comprise an air controller having a pump fluidly connected to an air chamber within a core of the mattress, wherein the air controller can be configured to adjust a fluid pressure within the air chamber.

A method is also discussed herein for attaching a mattress to a foundation. The method comprises positioning the mattress on the foundation, aligning a first zipper tape along a seam of an underside of the mattress with a second zipper tape along a seam of a top of the foundation, and coupling the mattress to the foundation by engaging teeth of the first zipper tape with teeth of the second zipper tape.

A system can include a foundation, a mattress, and a zipper. The mattress can have a mattress core and a mattress cover covering the mattress core. The zipper can connect the mattress core to the foundation. In some embodiments the system can have one, more or all of the following features. The mattress core can be an air chamber. The mattress cover can define a zipper hole through which the zipper extends when connecting the mattress core to the foundation. The foundation can be an adjustable foundation. The zipper can include a first tape attached to the mattress core and a second tape attached to a platform of the foundation. A second zipper can connect the mattress core to the foundation. The zipper can extend through the mattress cover.

Some embodiments of a bed system with zippers can provide several advantages. Use of the zippers can ensure that the mattress remains in place on the foundation and does not fall off the foundation over time. Additionally, zippers positioned interior to a perimeter of the mattress and interior to the perimeter of the foundation can be hidden from sight. As a result, the mattress and foundation can appear to be seamlessly coupled to each other. Moreover, the zipper can extend from the head end of the mattress to the foot end of the mattress and over one or more articulation points. As a result, when the adjustable foundation is actuated, the mattress can bend or articulate accordingly while the zipper can retain the mattress to the foundation. In other words, as the adjustable foundation is actuated and the mattress bends accordingly, the mattress can remain coupled to the foundation and bend with the foundation without falling off or becoming undesirable misaligned with the foundation. Furthermore, the zipper can be sewn into or along the seam of the mattress and the seam of the foundation so that the zipper can take advantage of the strength of the seam. As a result, the zipper can be less likely to come undone or break while the mattress is attached to the foundation. The zipper can also take advantage of the strength of the seam when the adjustable foundation is actuated and a portion of the mattress is raised or lowered. Finally, when the mattress has an air chamber within the mattress, a zipper can be included for retaining the air chamber to a mattress cover and another zipper can retain the mattress cover to the foundation. Such an arrangement with a zipper inside the mattress cover and another zipper outside the mattress cover can help hold the air chamber (or another mattress core for embodiments without an air chamber) in place during articulation of an adjustable foundation. In some embodiments, internal and external zippers can be aligned adjacent to one another so as to further strengthen connections. This can be especially beneficial when the adjustable foundation is actuated and a portion of the mattress is raised or lowered.

These and other embodiments can each optionally include one or more of the features described below. Particular embodiments of the subject matter described in this specification can be implemented so as to realize none, one, or more of the advantages described herein.

The details of one or more embodiments are set forth in the accompanying drawings and the description below. Other features, objects, and advantages of the invention will be apparent from the description and drawings, and from the claims.

DETAILED DESCRIPTION

Over time, a mattress can fall off or slide around on a foundation, such as an adjustable foundation. To overcome this concern, one or more zippers can be used to attach the mattress to the foundation. Accordingly, the mattress can be coupled (i.e., zippered) to the foundation. As a result, the mattress can remain in place on the foundation. The mattress can also be easily moved from or on the foundation by undoing the zipper. In embodiments of a bed system that has an adjustable foundation, the adjustable foundation can be used to selectively raise and lower a head and/or a foot of the mattress. In some embodiments, a mattress can be relatively heavy and/or flexible so as to naturally contour to the adjustable foundation's shape under force of gravity when one or more portions of the adjustable foundation are articulated. In other embodiments, a mattress can be relatively light weight and/or stiff so as to bend less under the force of gravity when one or more portions if the adjustable foundation are articulated. For either embodiment (and particularly for embodiments that have a mattress that is relatively light weight and/or stiff), a zipper attachment mechanism can be used to hold the mattress to the foundation during articulation such that the shape of the mattress can more closely follow the shape of the foundation.

Figure 1:
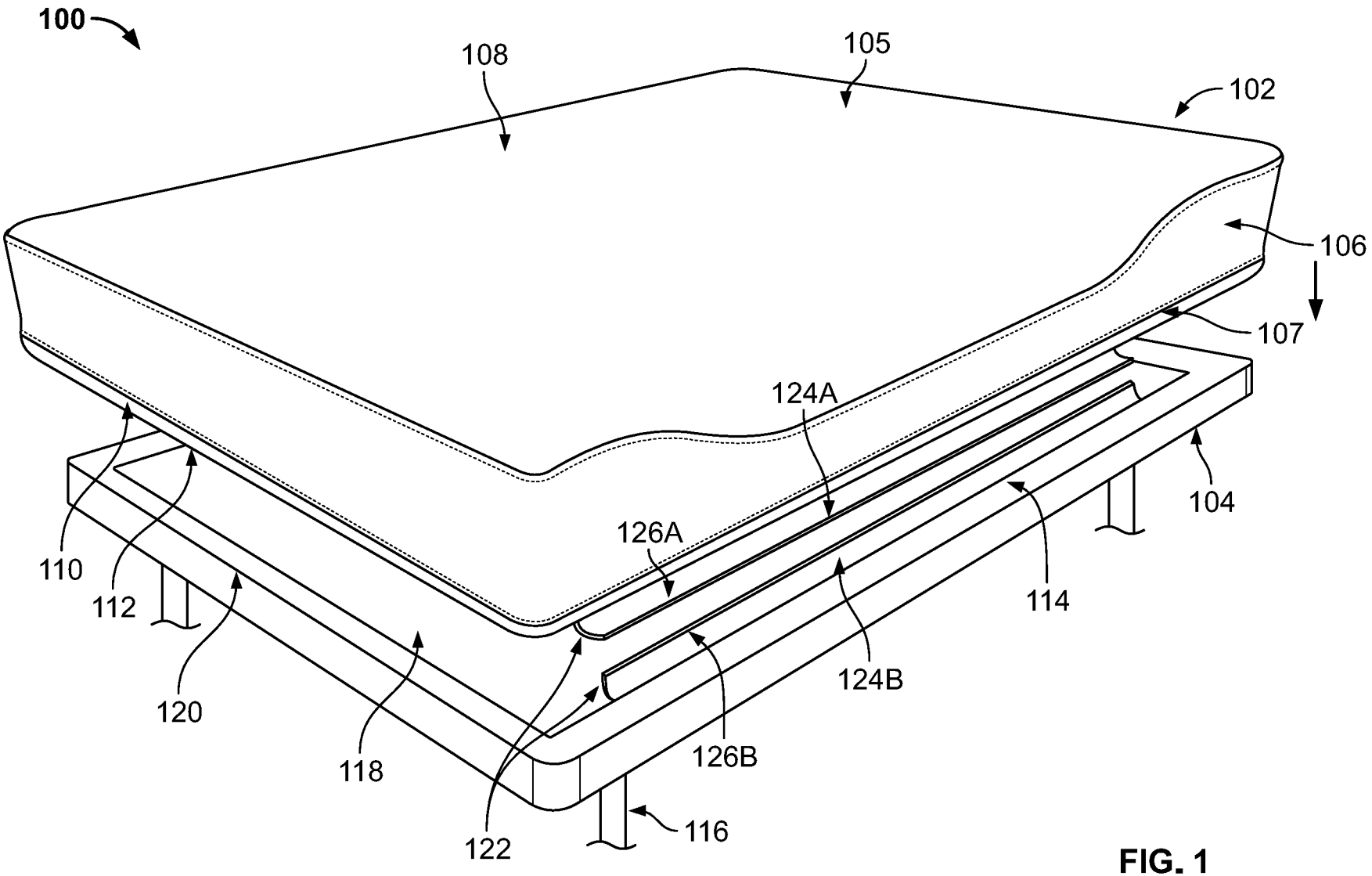
FIG. 1 depicts an embodiment of a bed system having a foundation and a mattress.

FIG. 1 discloses a bed system 100 that includes a mattress 102 and a foundation 104. The mattress 102 can have a mattress cover 106 that includes a fabric 105, and the mattress cover 106 can enclose various internal parts (not shown) of the mattress 102, such as foam, springs, air chambers, and or other components suitable for the application. The fabric 105 of the cover 106 can be hypoallergenic or any other type of material intended to protect the mattress 102 from spills, stains, bacteria, and other allergens. In some embodiments, the fabric of the mattress cover 106 can be water-resistant. The fabric of the cover 106 can also allow for airflow and breathability. The cover 106 can be configured to fit over the entire mattress 102. In some embodiments, the cover 106 can be zippered around the mattress 102. In other embodiments, the cover 106 can be held in place around the mattress 102 by any other mechanism including but not limited to velcro, buttons, snaps, or other fasteners. The cover 106 can further have one or more seams 107 that can run along a length of the cover 106, for example from a head end to a foot end of the cover 106. The one or more seams 107 can also be positioned interior to a perimeter of the cover 106. Moreover, the one or more seams can be positioned around corners of the cover 106 such that the cover 106 is fitted around the mattress 102 having a particular height, length, and width. In some embodiments, the cover 106 can be an optional addition to the bed system 100. In other embodiments, the cover 106 can already come fitted to the mattress 102 in the bed system 100. In some embodiments, the cover 106 can be removable.

The mattress 102 defines a mattress top 108, a mattress bottom 110, and a mattress perimeter 112. In some embodiments, the seams 107 of the mattress 102 can be positioned on one, more, or all of the mattress top 108, the mattress bottom 110, and the mattress perimeter 112. For example, in some embodiments the mattress 102 can have some of the seams 107 around the mattress perimeter 112. Such seams 107 can connect one piece of fabric to another piece of fabric. In some embodiments, the seams 107 can be functional, aesthetic, or both. In some embodiments, the mattress 102 can have seams 107 on the mattress bottom 110. Such seams can be hidden from view when the mattress 102 is positioned on the foundation 104.

The foundation 104 has a foundation perimeter 120. The foundation 104 can include a platform 114 and legs 116. The platform 114 can define a foundation top 118. In some embodiments, the platform 114 can be made from a wood material, including but not limited to wood (such as medium density fiberboard or plywood), or other materials suitable for the application. The platform 114 can be covered in fabric, batting, or other materials.

The platform 114 of the foundation 104 can have one or more panels (e.g. a head panel, a foot panel, and one or more middle panels). In some embodiments, the foundation 104 can be an adjustable foundation configured to raise and lower one or more panels of the platform 114, which, in turn, raise or lower portions of the mattress 102. The adjustable foundation can be actuated via a controller and/or manually actuated by a user.

The mattress 102 can be connected (i.e., coupled) to the foundation 104 by a zipper 122. In some embodiments, the mattress 102 can be coupled to the foundation 104 by multiple zippers 122. In the embodiment of FIG. 1, the zipper 122 extends from a position proximate a head end of the mattress 102 to a position proximate a foot end of the mattress 102. Thus, the zipper 122 extends substantially a full length of the mattress 102. In some embodiments, the bed system 100 further includes a second zipper 122 (see FIG. 2B) that extends substantially a full length of the mattress 102 on the other side of the mattress 102, substantially parallel to the zipper 122. The zipper 122 includes zipper tapes 124A and 124B and zipper teeth 126A and 126B attached to the zipper tapes 124A and 124B, respectively. The zipper tape 124A can be attached to the mattress cover 106 at the mattress bottom 110 and the zipper tape 124B can be attached to the platform 114 of the foundation 104 at the foundation top 118. For example, the zipper tape 124A can be sewn to an underside of the cover 106 and the zipper tape 124B can be sewn to a fabric on a top of the foundation 104. In other embodiments, the zipper tape 124A can be attached to the mattress 102 by other suitable mechanisms. In addition or alternatively, the zipper 122 can be arranged at a head side and/or a foot side of the mattress 102. For example, the zipper 122 can extend substantially a full length of the head side and/or the foot side of the mattress 102.

In other embodiments, the zipper 122 extends at a length shorter than the full length of the mattress 102. Further, in other embodiments, the mattress 102 can be coupled to the foundation 104 by a single, continuous zipper.

The zipper 122 can be configured to attach the mattress 102 to the foundation 104 and to hold the mattress 102 in place on the foundation 104. In embodiments in which the foundation 104 is an adjustable foundation, the zipper 122 can retain the mattress 102 in place when the foundation 104 raises and/or lowers one or more panels of the platform 114, which further raises and/or lowers one or more portions of the mattress 102. Moreover, in such embodiments, the zipper 122 can extend substantially a full length, from a location near the head end of the mattress 102 to a location near the foot end of the mattress 102, across one or more articulation points of the mattress 102 and the foundation 104. Portions of the mattress 102 and the foundation 104 that bend during actuation can be considered articulation points. For example, in embodiments when the platform 114 of the foundation has multiple panels, a joint between two adjacent panels can be considered an articulation point. Therefore, the zipper 122 can be able to retain the mattress 102 to the foundation 104 when the foundation 104 is actuated and one or more portions of the mattress 102 are raised and/or lowered in response to one or more panels of the platform 114 being raised and/or lowered.

In some embodiments, the zipper 122 can be hidden from sight. As a result, additional covers and/or fabric may not be required to hide the zipper 122 from sight. The zipper 122 can be arranged and sewn into the seam 107 of the mattress 102 such that the zipper 122 is not visible. When the zipper 122 is sewn into the seam 107, the zipper 122 can take advantage of strength already existing in the seam 107. Therefore, the zipper 122 can be less likely to come undone or break when retaining the mattress 102 to the foundation 104. This can be especially advantageous when the foundation 104 is adjustable and one or more panels of the platform 114 and one or more portions of the mattress 102 are raised and/or lowered.

Figure 2B:
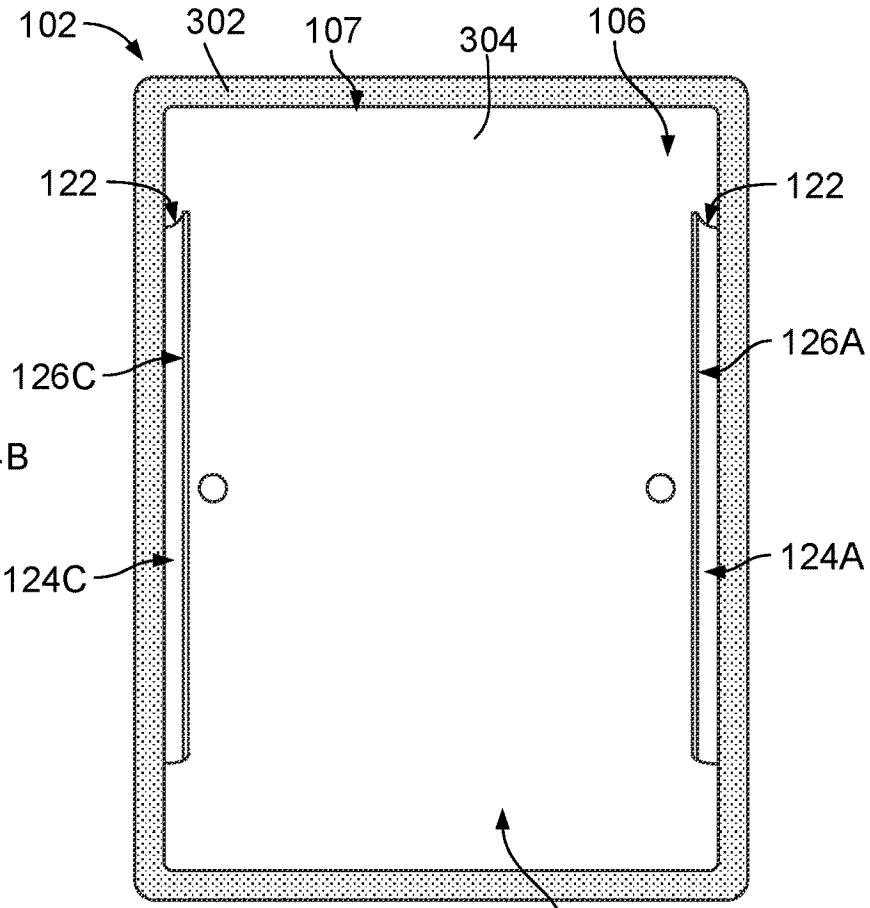
FIG. 2B is a bottom view of the mattress of FIG. 1.
Figure 2A:
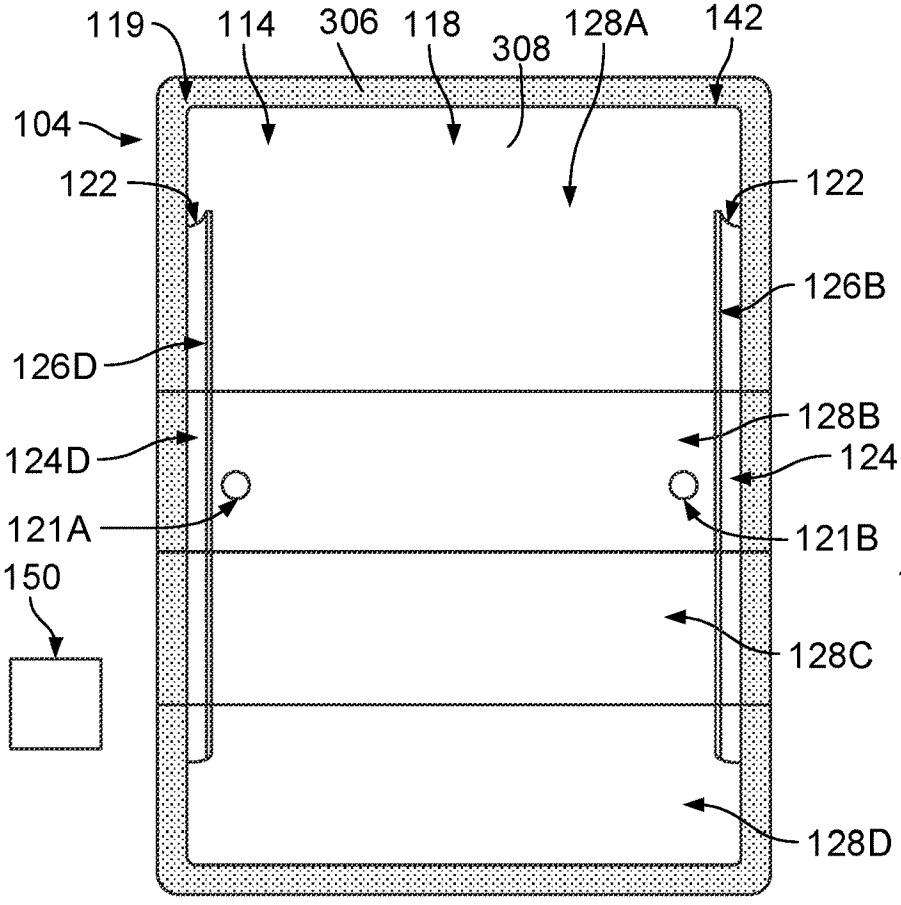
FIG. 2A depicts a top view of the foundation of FIG. 1.

FIG. 2A is a top view of the foundation 104. As shown in FIG. 2A, the foundation 104 has the foundation platform 114 (which at least partially defines the foundation top 118), and the zippers 122 that include zipper tapes 124B and 124D. Each zipper tape 124B and 124D have zipper teeth 126B and 126D, respectively. The teeth 126B and 126D are configured to couple with the zipper teeth of the zipper tapes attached to the bottom of the mattress 102 (e.g., as shown in FIG. 2B) and therefore retain the mattress 102 to the foundation 104. The foundation 104 can further have a foundation cover 119 with one or more fabric portions at least partially covering the platform 114. Fabric portions 306 and 308 of the foundation cover 119 can meet at one or more seams 142. The seams 142 can extend along an entire perimeter of the foundation top 118 (refer to FIG. 1, foundation perimeter 120). In some embodiments, the zipper tapes 124B and 124D can attach to the foundation top 118 at the seam 142, interior to the perimeter of the foundation 104. As a result, the zipper tapes 124B and 124D can take advantage of the strength of the existing seam 142 when the teeth 126B and 126D are coupled with the teeth of the zipper tapes attached to the mattress 102. In addition, the zipper 122 can be hidden from sight when the mattress 102 is coupled to the foundation 104. This is possible when the zipper tapes 124B and 124D are attached (i.e. sewn) interior to the perimeter of the foundation 104 and/or when the zipper tapes 124B and 124D are attached (i.e., sewn) into the seam 142.

In other embodiments, the seams 142 can extend along a portion of the perimeter of the foundation top 118. The zippers can attach to the foundation top 118 at the seams 142 as described above. In addition or alternatively, the zippers can extend along a portion of the foundation top 118 that has no seam.

In other embodiments, the zippers 122 need not be attached at seams. For example, in some embodiments the zippers 122 can be sewn to fabric at a location that does not include a seam. In other embodiments, the foundation cover 119 can be omitted and the zippers 122 can be attached to the foundation 104 via other suitable mechanisms, such as screws, bolts, rivets, or adhesive.

In some embodiments, the foundation 104 can define multiple passages 121A-B that extend through the foundation top 118. The passages 121A-B can be configured to allow passage of one or more hoses (not shown) through the foundation 104 and into the mattress 102. The passages 121A-B can be useful, for example, in embodiments where the mattress 102 is fluidically connected to an air source (not shown) in or under the foundation 104.

In some embodiments, the foundation 104 can be an adjustable foundation and the platform 114 can include multiple panels 128A-128D, including a head panel 128A, a middle panel 128B, a leg panel 128C, and a foot panel 128D. Each of the panels 128A-D can be moved when the adjustable foundation is actuated. When each of the panels 128A-D are moved, one or more portions of the mattress 102 attached to the foundation 104 by the zipper 122 can also be moved accordingly. For example, if the head panel 128A of the platform 114 is raised, the mattress 102 is raised as well at a head portion of the mattress 102, and the mattress 102 remains coupled to the foundation 104 by the zipper 122.

The foundation 104 can include an actuator (not shown) operably connected to each of the panels 128A-D of the platform 114 so as to actuate one or more of the panels 128A-D between raised and lowered positions in response to actuation by the actuator and a controller 150 operably connected to the actuator and configured to electronically drive the actuator to actuate one or more of the panels 128A-D between raised and lowered positions. In some embodiments, the one or more panels 128A-D can be actuated manually by the user with or without the controller 150. In other embodiments, the one or more panels 128A-D can be actuated automatically by the controller 150. The controller 150 can be configured to raise and/or lower one or more of the panels 128A-D from a predetermined minimum height to a predetermined maximum height. For example, using the controller 150, the user can raise the head panel 128A to a maximum height position while lowering the foot panel 128D to a minimum height position. Each of the panels 128A-D can be adjusted to a same height such that the user lays flat on top of the mattress 102.

FIG. 2B is a bottom view of the mattress 102. As shown in FIG. 2B, the mattress 102 includes the mattress bottom 110, the mattress cover 106, and the zippers 122. The zippers 122 further includes zipper tapes 124A and 124C which connect to zipper teeth 126A and 126C, respectively. The zipper teeth 126A and 126C are configured to couple with corresponding zipper teeth of the zipper tapes attached to the foundation 104 (shown in FIG. 2A) and therefore retain the mattress 102 to the foundation 104. In some embodiments, the zipper tapes 124A and 124C can attach to the mattress bottom 110 at one or more of the seams 107 interior to a perimeter of the mattress 102. As a result, the zipper tapes 124A and 124C can take advantage of the strength of the existing seam 107 when the teeth 126A and 126D are coupled with the teeth and the zipper tapes attached to the foundation 104. Fabric portions 302 and 304 of the mattress 102 can meet at one or more of the seams 107. In addition, the zipper 122 can be hidden from sight when the mattress 102 is coupled to the foundation 104. This is possible when the zipper tapes 124A and 124C are attached (i.e. sewn) interior to the perimeter of the mattress 102, such as when the zipper tapes 124A and 124C are attached (i.e., sewn) into the seam 107.

Figure 3:
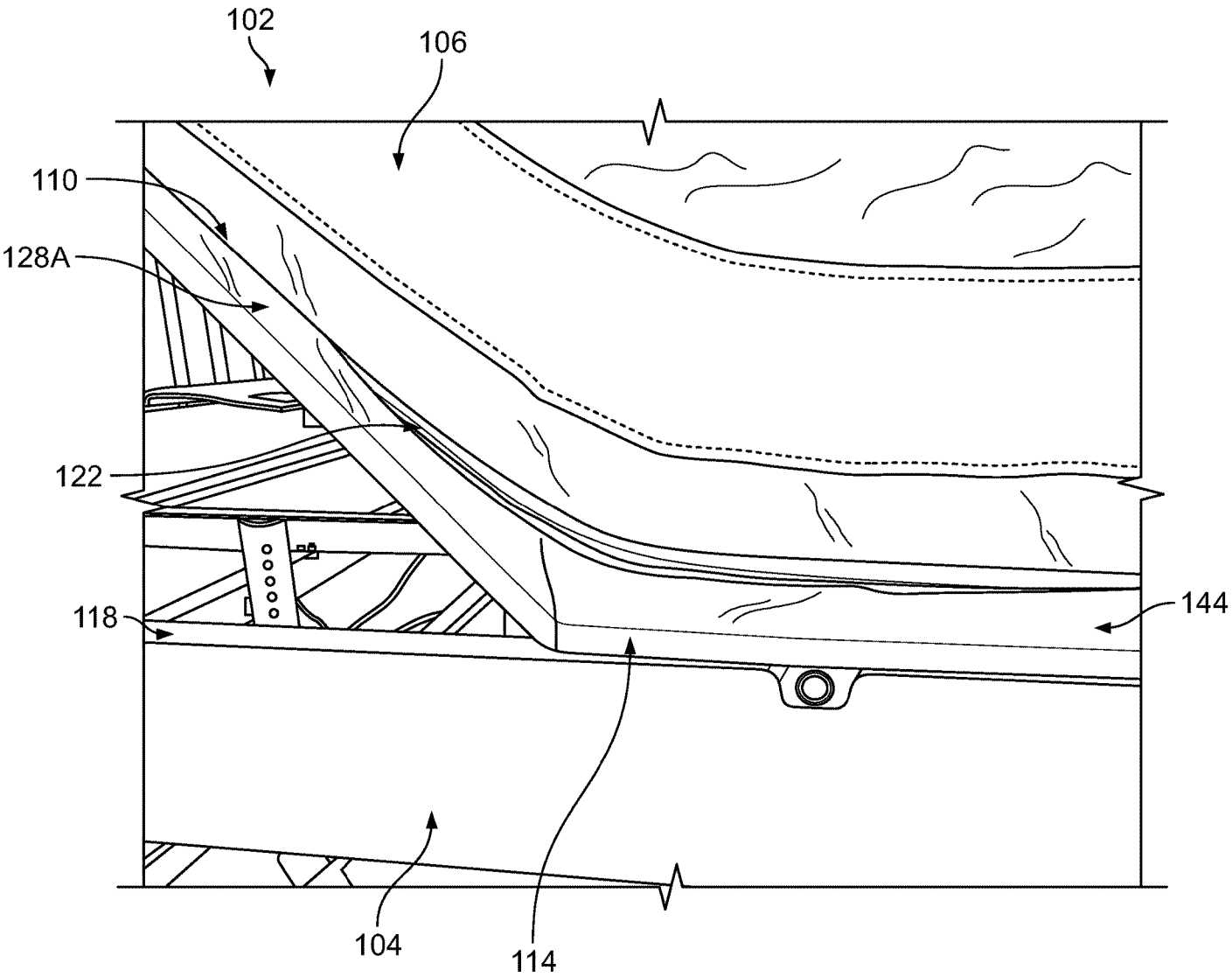
FIG. 3 is a side view of the foundation and mattress of FIG. 1.

FIG. 3 is a side view of the foundation 104 and the mattress 102 when the foundation 104 is an adjustable foundation. The foundation 104 can be actuated manually, by the user, and/or automatically by the controller, as previously described (refer to FIG. 2A). The mattress 102 is enclosed in the mattress cover 106 and the platform 114 of the foundation 104 is enclosed (i.e., covered) in the foundation cover 144, as previously described. The zipper 122 extends from a position near the head end of the mattress 102 to a position near the food end of the mattress 102 and couples and retains the mattress 102 to the platform 114 when the foundation 104 is actuated. As a result, the zipper 122 extends over one or more articulation points of the foundation 104 and the mattress 102. In some embodiments, a zipper tape of the zipper 122 is attached to a bottom of the cover 106 and another zipper tape of the zipper 122 is attached to a top of the foundation cover 144.

The mattress bottom 110 is raised when the head panel 128A of the platform 114 (refer to FIG. 2A) is actuated/raised by the controller 150. As a result, the head portion of the mattress 102 is also raised. As previously discussed, when the foundation 104 is an adjustable foundation and it is actuated, the mattress 102 remains coupled to the foundation 104 as one or more panels 128A-D of the platform 114 of the foundation 104 are raised and/or lowered, thereby raising and/or lowering the associated portions of the mattress 102.

In some embodiments, the zipper tape 124A can be attached directly to the mattress 102 (e.g. sewn to the mattress cover of the mattress 102) and the zipper tape 124B can be attached directly to the foundation 104 (e.g. to a cover of the foundation 104) without additional lengths of extension fabric in-between. In such embodiments, the zipper 122 can provide a relatively tight connection between the mattress and the foundation. For example, in embodiments where the zipper tapes 124A and 124B have a width of between about 1 and about 2 inches, then the zipper 122 can hold the mattress 102 to the foundation 104 with a gap of about 1 to about 2 inches. In other embodiments, the zipper tapes 124A and 124B can be narrower or wider for applications where tighter or looser connections are deemed desirable. In still other embodiments, one or more portions of fabric can be added as an extension where looser connections between the mattress 102 and the foundation 104 are deemed desirable.

In some embodiments, the zipper 122 can be spaced inward from a perimeter of the mattress 102 and the foundation 104 by an amount suitable to substantially conceal the zipper 122 from view and suitable to allow for sheets to be tucked in between the mattress 102 and the foundation 104. For example, the zipper 122 can be spaced inward from a perimeter of the mattress 102 and the foundation 104 by between about 2 and about 4 inches.

In some embodiments, the bed system 100 can include exactly two zippers 122 that connect the mattress 102 to the foundation 104. For example, a first zipper 122 can extend longitudinally along a left side of the bed system and a second zipper 122 can extend along a right side of the bed system.

In some embodiments, the bed system 100 can include exactly one zipper 122 that connects the mattress 102 to the foundation 104. For example, the zipper 122 can follow a full (or nearly full) loop whereby the zipper 122 extends along a top portion, a left side, a bottom portion, and a right side of the bed system 100. In one example, the zipper 122 can extend along a left side of the bed system 100, turn and extend along a foot side of the bed system 100, turn and extend along a right side of the bed system 100, and turn and extend along a top side of the bed system 100. In some embodiments with a single zipper 122 connecting the mattress 102 to the foundation 104, the zipper 122 can be positioned under the mattress 102 at a location inward of the perimeter of the mattress so as to have a gap between the perimeter of the mattress 102 and the zipper 122.

In some embodiments, the bed system 100 can have more than two zippers 122 that connect the mattress 102 to the foundation 104.

Figure 4:
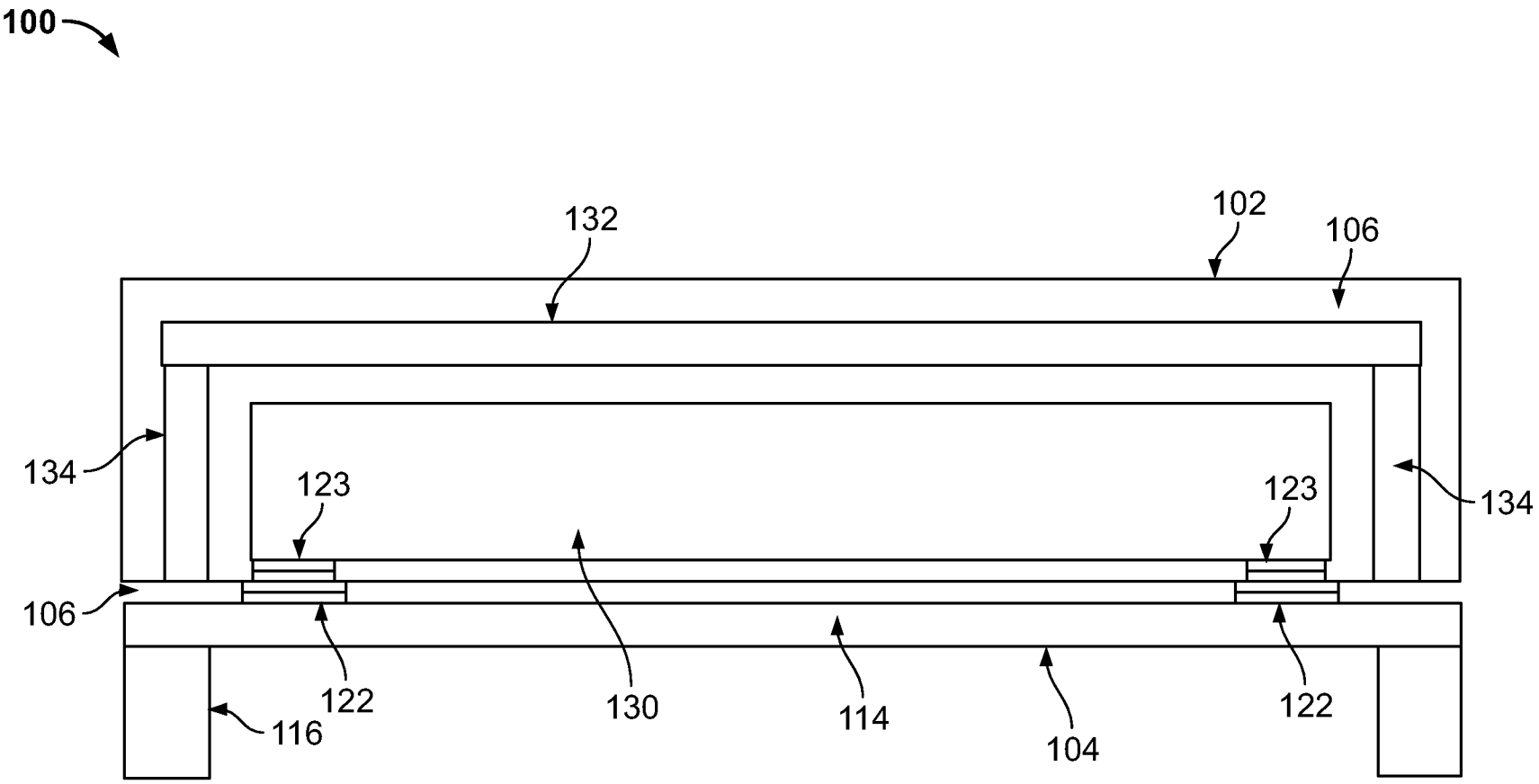
FIG. 4 is a schematic end view of the bed system of FIG. 1.

FIG. 4 is a schematic view of the bed system 100 when viewed from the head end. As shown in FIG. 4, the foundation 104 can include the legs 116 and the platform 114. In some embodiments, the foundation 104 is an adjustable foundation (refer to FIG. 3), wherein one or more panels 128A-D of the platform 114 can be adjusted to a raised or lowered height (refer to FIG. 2A). The platform 114 can be made from wood, such as medium density fiberboard or plywood, and covered in a fabric, as previously described throughout this disclosure.

The mattress 102 can be placed on top of the platform 114 of the foundation 104.

In some embodiments, the mattress 102 can include one or more air chambers 130 and one or more foam portions 132 covered in the mattress cover 106. The air chamber 130 can be an inflatable air chamber filled with air to provide support to one or more portions of the mattress 102. The amount of air in the air chamber can be adjusted by using an air controller having a pump or blower. As a result, fluid pressure in the air chamber 130 can be customized to change the firmness and/or support of the mattress 102. In some embodiments, the air chamber 130 can extend a full length of the mattress 102, from the head end to the foot end of the mattress 102. In other embodiments, the air chamber 130 can be placed in a particular portion of the mattress 102 (i.e., only at the head end and/or only at the foot end of the mattress 102). In yet other embodiments, multiple air chambers can be placed within the mattress 102 and each air chamber can be individually controlled/manipulated by the controller. In alternative embodiments, the air chamber 130 can be replaced with another type of mattress core suitable for the application.

The air chamber 130 can be surrounded on one or more sides by one or more foam members 134. For example, in some embodiments the foam members 134 can include a top foam member 134 and a number of side foam members 134 that combine to form an upside down foam tub 132 that can be placed on top of the air chamber 130 within the mattress 102. In other embodiments, the mattress 102 can have one or more foam members that are sized, shaped, and positioned differently than as illustrated in FIG. 4, or can have no foam members. In some embodiments, the mattress 102 can include one or more foam members 134 without the air chamber 130. For example, the air chamber 130 can be replaced with a mattress core that includes foam, springs, and/or other suitable materials.

The air chamber 130 can be formed of a layer of polymer material configured to substantially retain air and a layer of fabric configured to provide reinforcing strength. In some embodiments, such a combination of materials can be advantageous in making the air chamber 130 durable and substantially airtight. As a result, the combination of materials can substantially retain air within the air chamber 130 when weight is added on top of the mattress 102 and/or the mattress 102 is bent and/or articulated when the adjustable foundation is actuated.

Still referring to FIG. 4, a bottom of the air chamber 130 can be attached to the mattress cover 106 by a zipper 123. In some embodiments, the zipper 123 can extend substantially a full length of the air chamber 130 and/or the mattress 102. In other words, the zipper 123 can extend from a head end of the air chamber 130 to a foot end of the air chamber 130. In such embodiments, the zipper 123 can be sewn into (i.e., along) a seam of the air chamber 130. Therefore, the zipper 123 can take advantage of the existing strength in the seam of the air chamber 130 such that the zipper 123 does not become undone or break when the zipper 123 retains the air chamber 130 to the mattress 102. In some embodiments, the zipper 123 can be attached at one or more corners of the air chamber 130 such that the zipper 123 can take advantage of the strength of an existing seam along the one or more corners of the air chamber 130.

In addition to the zipper 123 connecting the air chamber 130 to the mattress cover 106, the zipper 122 can further connect the mattress cover 106 to the foundation 104. The zipper 122 can couple the mattress 102, via the cover 106, to the foundation 104. The zipper 123 can be arranged adjacent the zipper 122 (i.e., vertically aligned) such that both zippers 122 and 128 act together to form a relatively strong connection between the air chamber 130 and the foundation 104. Moreover, if the zippers 122 and 128 are aligned along seams of the air chamber 130, the mattress cover 106, and the foundation 104, the zippers 122 and 128 can take advantage of the existing strength from the seams. As a result, the connection between the mattress 102 and the foundation 104 can be relatively strong, especially where the foundation 104 is an adjustable foundation and the foundation 104 is actuated.

In some embodiments, the air chamber 130 can be omitted. For example, the mattress 102 can include a mattress core (that does not necessarily have any air chambers) inside the mattress cover 106. One or more zippers 128 can connect the mattress core to the mattress cover 106 and one or more zippers 122 can connect the mattress cover 106 to the foundation 104. Accordingly, a combination of one or more zippers 128 inside the mattress 102 and one or more zippers 122 outside of the mattress 102 can function to retain a mattress core (with our without an air chamber) in position on an adjustable foundation.

FIG. 5*s* a schematic elevation view of a portion of the bed system 100 in one embodiment, showing a portion of the zippers 122 and 128. The bed system 100 includes the foundation 104 and the mattress 102 (including the mattress cover 106 and the air chamber 130). In this example, the first zipper 122 connects (i.e., couples) the mattress cover 106 to the top 118 of the foundation 104 at the platform 114. The zipper tape 124A can connect the zipper teeth 126A to the mattress 102 (such as by being sewn along a seam, in some embodiments). The zipper tape 1246 can connect the zipper teeth 1266 to the top 118 of the foundation 104 at the platform 114 (such as by being sewn along a seam, in some embodiments). When the zipper 122 is zipped, the zipper teeth 126A can be connected to the zipper teeth 1266 such that the zipper 122 can connect the mattress 102, via the mattress cover 106, to the top 118 of the foundation 104 at the platform 114. In other words, when zipper teeth 126A and zipper teeth 126B are coupled, the zipper 122 can securely attach the mattress 102 to the foundation 104.

In some embodiments, a second zipper, the zipper 123, can be used to retain the air chamber 130 (or another mattress core that does not necessarily include an air chamber). For example, the zipper 123 can connect an exterior underside (i.e., bottom) of the air chamber 130 to an interior portion of the mattress cover 106. The zipper 123 can include zipper tapes 136A and 1366 that connect to corresponding zipper teeth 138A and 1386. The zipper tape 136A can connect the zipper teeth 138A to the mattress air chamber 130 (such as by being sewn to a bottom portion of the air chamber 130, in some embodiments). The zipper tape 1366 can connect the zipper teeth 1386 to the mattress cover 106 (such as by being sewn along a seam, in some embodiments). When the zipper 123 is zipped, the zipper teeth 138A can be connected to the zipper teeth 1386 such that the zipper 123 can connect the air chamber 130 to the mattress cover 106.

This configuration of the zippers 122 and 128 can be beneficial in embodiments where the foundation 104 is an adjustable foundation. When the foundation 104 is actuated and one or more panels 128A-D comprising the platform 114 of the foundation 104 are raised and/or lowered, the one or more portions of the mattress 102 and one or more corresponding portions of the air chamber 130 move accordingly. For example, if the head panel 128A of the platform 114 is raised, then the corresponding portion of the mattress 102 is raised, as well as any part of the air chamber 130 that is located in that corresponding portion.

Figure 5:
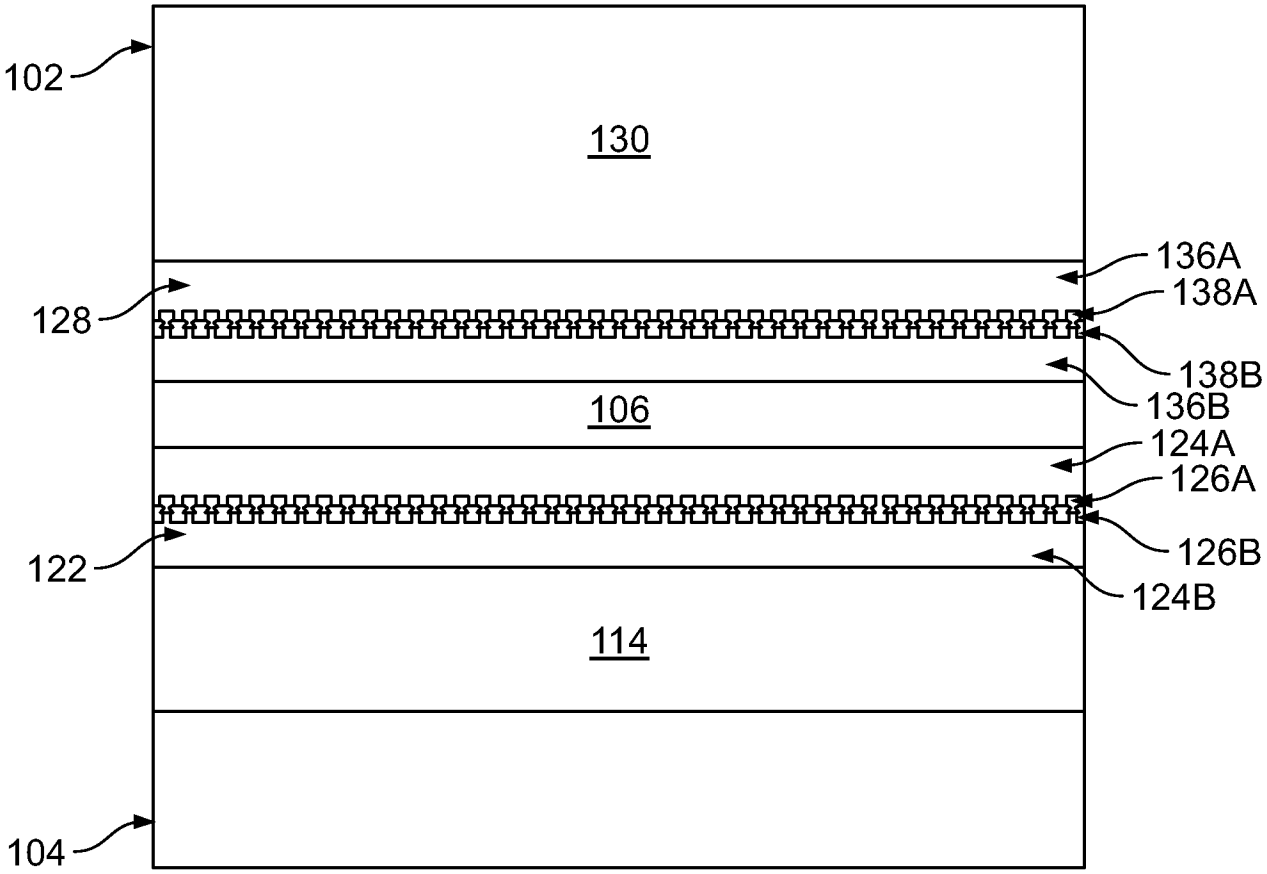
FIG. 5 is a view of two zippers as implemented in one embodiment of the bed system of FIG. 1.
Figure 6:
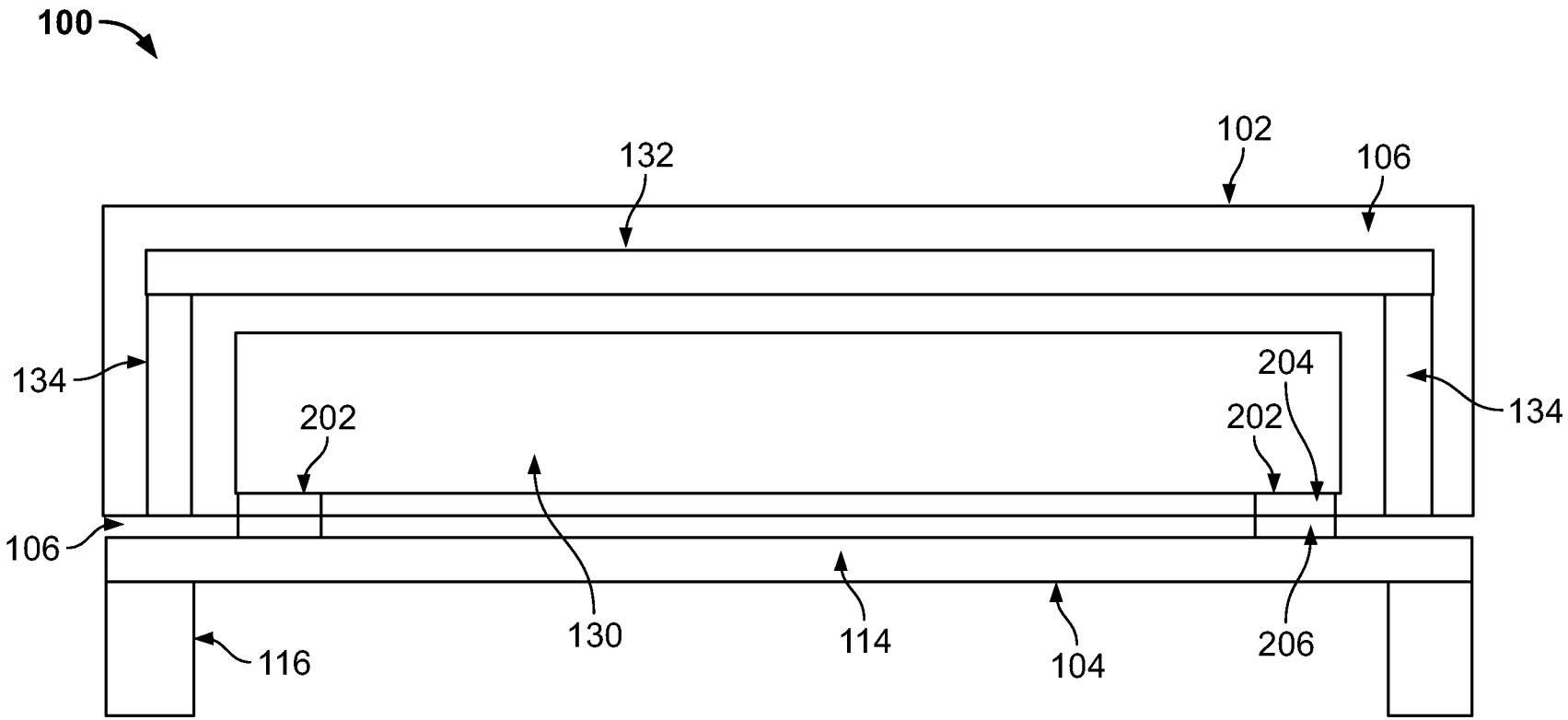
FIG. 6 is a schematic view of another embodiment of a bed system.

FIG. 6 is a schematic view of the bed system 200 when viewed from the head end. The bed system 200 is similar to the bed system 100 (shown in FIGS. 1-5) except that the bed system 200 has a different zipper configuration. The bed system 200 includes zippers 202 extending from the air chamber 130 to the platform 114 of the foundation 104. The zippers 202 can each include first and second zipper tapes 204 and 206, with the zipper tape 204 connected to the air chamber 130 and the zipper tape 206 connected to the foundation 104. The zipper tapes 204 and 206 can be zipped together in order to connect the air chamber 130 to the foundation 104 and hold the air chamber 130 in place on the foundation 104, such as during actuation of the foundation 104.

In some embodiments, the mattress cover 106 can define holes through which the zippers 202 extend between the air chamber 130 and the foundation 104. This can allow the zippers 202 to connect the air chamber 130 directly to the foundation 104 without additional intervening zippers. For example, the zipper 202 can extend a full distance between the air chamber 130 and the foundation 104 as opposed to using two zippers to span the same distance, such as shown in FIGS. 4 and 5.

A number of embodiments of the invention have been described. Nevertheless, it will be understood that various modifications may be made without departing from the spirit and scope of the invention. For example, the shape, size, and location of various components of the mattress, foundation, and zipper can be modified as suitable for the application. Similarly, one or more features present on one or more of the various embodiments can be considered optional, and need not necessarily be included in all embodiments. Accordingly, other embodiments are within the scope of the following claims.

What is claimed is:

1. A bed system comprising:
an adjustable foundation;
a mattress positioned on the adjustable foundation, wherein the mattress has a head end and a foot end; and
a zipper that extends along longitudinal sides of the mattress from the head end to the foot end of the mattress and connects the mattress to the adjustable foundation, wherein the zipper terminates near the head end and the foot end of the mattress, wherein the zipper comprises a first zipper tape attached along a seam of an underside of the mattress and a second zipper tape attached along a seam of a top of the adjustable foundation, wherein the first and second zipper tapes include first and second teeth, respectively, and the second teeth are configured to engage the first teeth.

2. The system of claim 1, wherein the zipper connecting the mattress to the adjustable foundation is configured to retain the mattress to the adjustable foundation when the adjustable foundation is actuated to raise at least one of the head end and the foot end of the mattress.

3. The system of claim 1, wherein the adjustable foundation provides at least one articulation point, and wherein the zipper extends across the at least one articulation point.

4. The system of claim 3, wherein the adjustable foundation comprises a platform with at least a head panel, a middle panel, and a foot panel, wherein at least one panel is raised or lowered when the adjustable foundation is actuated, and wherein the articulation point is positioned between the head panel and the middle panel such that the zipper extends along a portion of the head panel, across the articulation point, and along a portion of the middle panel.

5. The system of claim 1, further comprising an air chamber within the mattress, wherein a second zipper connects the air chamber to an interior portion of the mattress.

6. The system of claim 5, wherein the zipper connecting the mattress to the adjustable foundation is substantially vertically aligned in a stack with the second zipper connecting the air chamber to the interior portion of the mattress.

7. The system of claim 5, wherein the second zipper is attached along a seam of a bottom of the air chamber.

8. The system of claim 1, further comprising a mattress cover surrounding the mattress, wherein the zipper is attached to the mattress cover and configured to couple the mattress cover to the top of the adjustable foundation at a bottom of the mattress.

9. The system of claim 8, wherein the zipper is attached along a seam of an exterior underside of the mattress cover at a location spaced inward from a perimeter of the mattress.

10. The system of claim 5, wherein the second zipper is attached at a corner of the air chamber.

11. The system of claim 5, further comprising an upside down foam tub positioned above the air chamber, wherein the upside down foam tub has an opening at a bottom of the upside down foam tub sized to receive the air chamber in the upside down foam tub.

12. The system of claim 1, wherein the adjustable foundation further comprises:
an actuator; and
a controller operably connected to the actuator and configured to drive the actuator to actuate at least one portion of the adjustable foundation between a lower position and an upper position.

13. The system of claim 5, further comprising an air controller having a pump fluidly connected to the air chamber, wherein the air controller is configured to adjust a fluid pressure within the air chamber.

14. A bed system comprising:
an adjustable foundation having first and second foundation fabric portions connected at a first seam that is spaced inward from a perimeter of the adjustable foundation;
a mattress positioned on the adjustable foundation, wherein the mattress has a head end and a foot end, wherein the mattress further has first and second mattress fabric portions connected at a second seam that is spaced inward from a perimeter of mattress; and
a zipper that extends from the head end to the foot end of the mattress and connects the mattress to the adjustable foundation, wherein the zipper comprises a first zipper tape attached along the second seam and a second zipper tape attached along the first seam, wherein the first and second zipper tapes include first and second teeth, respectively, and the second teeth are configured to engage the first teeth, wherein the first zipper tape is attached to the underside of the mattress at the second seam that is spaced inward from the perimeter of the mattress by sewing the first zipper tape into the second seam and wherein the second zipper tape is attached to a top of the adjustable foundation at first seam that is spaced inward from the perimeter of the adjustable foundation by sewing the second zipper tape into the first seam.

* * * * *